US009320348B2

(12) United States Patent
Sabet

(10) Patent No.: US 9,320,348 B2
(45) Date of Patent: Apr. 26, 2016

(54) FINGER MOUNTED TOOTHBRUSH

(71) Applicant: Julienne Sabet, Carrboro, NC (US)

(72) Inventor: Julienne Sabet, Carrboro, NC (US)

( * ) Notice: Subject to any disclaimer, the term of this patent is extended or adjusted under 35 U.S.C. 154(b) by 194 days.

(21) Appl. No.: 13/763,131

(22) Filed: Feb. 8, 2013

(65) Prior Publication Data

US 2014/0223682 A1 Aug. 14, 2014

(51) Int. Cl.
*A46B 5/04* (2006.01)

(52) U.S. Cl.
CPC ..... *A46B 5/04* (2013.01)

(58) Field of Classification Search
CPC ..... A46B 5/04
USPC ..... 15/167.1, 227; D4/103
See application file for complete search history.

(56) References Cited

U.S. PATENT DOCUMENTS

| | | | | | |
|---|---|---|---|---|---|
| 2,103,083 | A | * | 12/1937 | Lynch | 601/139 |
| 2,167,129 | A | * | 7/1939 | Sleeper | 15/195 |
| 2,379,624 | A | * | 7/1945 | Chisnell | 294/25 |
| 3,043,295 | A | * | 7/1962 | Ward | 601/139 |
| 4,308,860 | A | * | 1/1982 | Sanders et al. | 601/137 |
| 4,733,410 | A | | 3/1988 | Glotkin | |
| 5,287,584 | A | | 2/1994 | Skinner | |
| 5,636,405 | A | | 6/1997 | Stone et al. | |
| 5,765,252 | A | * | 6/1998 | Carr | 15/104.94 |
| 5,826,599 | A | | 10/1998 | Adams | |
| 6,584,637 | B1 | * | 7/2003 | Witter | 15/160 |
| 6,647,549 | B2 | | 11/2003 | McDevitt et al. | |
| D485,072 | S | | 1/2004 | Brown-Paschal | |
| D537,165 | S | * | 2/2007 | Leite et al. | D24/147 |
| D576,796 | S | * | 9/2008 | Roman | D4/103 |
| D615,304 | S | * | 5/2010 | Cole et al. | D4/103 |
| 7,895,695 | B2 | * | 3/2011 | Bernini et al. | 15/104.94 |
| D700,349 | S | * | 2/2014 | Tai | D24/215 |
| 2009/0035048 | A1 | | 2/2009 | Safieh | |

* cited by examiner

*Primary Examiner* — Randall Chin
(74) *Attorney, Agent, or Firm* — The Concept Law Group, P.A.; Scott D. Smiley; Erin A. Martin

(57) ABSTRACT

A finger-mounted toothbrush having a body and a plurality of cleaning members, the body having a proximal end, a distal end opposite to the proximal end, and a length separating the proximal and distal ends, the body also defining a proximal opening at the proximal end and having an inner surface defining a cavity extending from the proximal opening to a terminal location along the body length, wherein the cavity is sized for an average-sized human finger, the body further having an outer surface spanning from the proximal end to the distal end. The plurality of cleaning members project outwardly from the outer surface of the body, substantially span the body length, and define a plurality of cleaning member voids.

20 Claims, 5 Drawing Sheets

100

100

500

600

FINGER MOUNTED TOOTHBRUSH

FIELD OF THE INVENTION

The present invention relates generally to teeth cleaning apparatuses, and, more particularly relates to finger-mounted toothbrushes.

BACKGROUND OF THE INVENTION

Dental hygiene is important for most people. Failure to maintain the cleanliness of a person's teeth can cause significant negative consequences such as cavities, plaque, and unpleasant odors, among others. Caring for a child's teeth can be especially problematic for many parents as most children are disinterested or uncooperative in the process. As such, parents are either forced to constantly monitor their children when brushing their teeth, participate in the cleaning themselves, or hope their child accomplishes the often unaccomplished task of a thorough teeth cleaning. As children, particularly infants, squirm and are generally unreceptive to objects entering their mouths, a parent's participation in cleaning their child's teeth is often stressful, eventful, and ultimately, time consuming. Although many of these problems are associated with children, they are also prevalent with the elderly or incapacitated.

Those known standard toothbrushes, which have a handle with a plurality of bristles at one end, often fall short of facilitating an effective and efficient cleaning of a child's teeth. This is true regardless of the whether the parent or child is doing the cleaning. For example, should a parent desire to clean his or her child's teeth, the parent is often unable to determine which teeth he or she has reached and cleaned because the cleaning end of the toothbrush is out-of-sight from the parent. Even more worrisome is the possibility of placing the end of the toothbrush in a location that initiates the child's gag reflex, or even worse, causes the child to choke. Furthermore, these standard toothbrushes generate a more time-intensive cleaning process for parents as there is only side of the brush that can clean the child's teeth. As such, parents are forced to spend a considerable amount of time to ensure a proper cleaning. These standard toothbrushes are also problematic for children or disabled persons who desire to clean their own teeth. This is chiefly because the handle is difficult to hold and operate. For example, a child's hands are often too small to effectively handle the toothbrush, thereby requiring the child to continually change his or her grip on the toothbrush. This often leads to a child dropping the toothbrush or becoming discouraged. Because most children are also trying to finish the cleaning process as quickly as possible, they often miss brushing one or more sections of their teeth, leading to an insufficient and ineffective cleaning.

Some known finger-mounted cleaning apparatuses or toothbrushes (hereinafter "FMT(s)") have attempted to address some of the above problems, but most, if not all, have fallen short of a complete and effective solution. Similar to standard toothbrushes, some known FMTs only have the cleaning portion, e.g., bristles, placed on a particular area of the toothbrush. Therefore, the FMT is unable to effectively clean multiple teeth at the same time. Furthermore, the parent is required to spend more time to ensure a complete cleaning of the child's teeth. Some known FMTs have bristles surrounding the circumferential perimeter of one section of the toothbrush, but not along the body of the FMT. As such, these FMTs do not efficiently and effectively clean multiple sections of a child's teeth in a single instance, or in a continuous singular motion.

Some known FMTs are a hybrid-style toothbrush, as they have a portion that is sized to receive a person's finger and an elongated extension that spans to the cleaning portion, e.g., bristles. These types of FMTs are also problematic for many users and suffer from many of the deficiencies described for standard toothbrushes. For example, as there is an extension, the parent or child is unable to determine exactly where the cleaning portion is located. This leads to an ineffective cleaning as sections of a child's teeth are missed or passed over. This may also place the cleaning portion of the FMT in a location that could potentially harm the child.

Moreover, some known FMTs have the portion of the toothbrush, which is sized to receive a user's finger, placed away from the cleaning portion of the toothbrush such that the parents are unable to determine when the child is experiencing discomfort. Generally when a person experiences pain or discomfort within their mouth there is a natural tendency to close the mouth slightly. Those FMTs that do not have the finger portion within the proximity of the cleaning portion, do not allow the parent to effectively measure when the child's jaw/mouth is closing. Any FMTs that do have the finger portion within the proximity of the cleaning portion do not simultaneously prevent the user's finger from being injured should the child's teeth close on the body of the FMT, as the body of the FMT is typically formed from a thin piece of material.

Other known FMTs have portions of the body that are often hard and uncomfortable to many users. These hard portions of the FMT may chip or otherwise damage the child's teeth, in addition to causing discomfort to the child. Other known FMTs and finger-mounted apparatuses, such as finger-mounted cots and teething devices, also suffer from many of the above-described deficiencies as they are inoperable or ineffective for cleaning a person's teeth. Furthermore, most, if not all, known FMTs are not inviting or do not have an aesthetically pleasing appearance to a child which many parents and children also find problematic.

Therefore, a need exists to overcome the problems with the prior art as discussed above.

SUMMARY OF THE INVENTION

The invention provides a finger-mounted toothbrush that overcomes the hereinafore-mentioned disadvantages of the heretofore-known devices and methods of this general type and that motivates people, more specifically children, to brush their teeth and, when they are brushing their teeth, to have a more thorough cleaning.

With the foregoing and other objects in view, there is provided, in accordance with the invention, a finger-mounted toothbrush that includes a body, a proximal end, a distal end opposite to the proximal end, and a length separating the proximal and distal ends. The finger-mounted toothbrush also defines a proximal opening at the proximal end, includes an inner surface defining a cavity extending from the proximal opening to a terminal location along the body length, the cavity sized for an average-sized human finger, and includes an outer surface spanning from the proximal end to the distal end. The finger-mounted toothbrush also has a plurality of cleaning members that project outwardly from the outer surface of the body, substantially span the entire body length, and define a plurality of cleaning member voids.

In accordance with another feature, an embodiment of the present invention includes the plurality of cleaning members substantially surrounding the outer surface of the body.

In accordance with a further feature, an embodiment of the present invention also includes the terminal location located substantially at the distal end of the body.

In accordance with a further feature of the present invention, the plurality of cleaning members each include a distal end, wherein the distal ends of the cleaning members spanning longitudinally along the body length are substantially aligned with one another. The distal ends of the cleaning members may also follow the shape of the body without being considered unaligned with one another.

In accordance with an another exemplary embodiment, the present invention includes a foraminous first layer that includes the outer surface of the body and a second layer that includes the plurality of cleaning members, wherein a superposition of the first layer over the second layer places the cleaning members in a position that projects outwardly from the outer surface of the body.

In accordance with yet another exemplary embodiment, the present invention also includes a third layer that includes the inner surface of the body, the third layer placing the second layer in an interposing relationship with the first and third layers.

In accordance with a further feature of the present invention, the first and third layers are of a substantially resilient, polymer-based, material.

In accordance with a further feature of the present invention, the body has an at least three-layer layup, wherein two layers of the at least three-layer layup are a substantially resilient, polymer-based, material.

In accordance with another feature, an embodiment of the present invention also includes an image located substantially at the distal end of the body.

In accordance with an additional feature, the body is at least partially formed in a shape of at least one of an animal and a character.

In accordance with the present invention, a finger-mounted toothbrush also includes a body that has a proximal end, a distal end opposite to the proximal end, and a length separating the proximal and distal ends. The body also defines a proximal opening at the proximal end and has an outer surface and an inner surface, the inner surface defining a cavity extending from the proximal opening to a terminal location along the body length and sized for an average-sized human finger. The finger-mounted toothbrush also includes a plurality of bristle-like cleaning members that extend outwardly from the outer surface of the body, substantially surrounds a circumferential outer surface of the body, and spans discontinuously along the body length.

In accordance with another feature, an embodiment of the present invention also includes the outer surface of the body being substantially convex and the inner surface of the body being substantially concave.

In accordance with the present invention, a finger-mounted toothbrush includes a body that: (1) has a proximal end, a distal end opposite to the proximal end, and a length separating the proximal and distal ends, (2) defines a proximal opening at the proximal end, (3) has an inner surface defining a cavity extending from the proximal opening to a terminal location along the body length, the cavity sized for an average-sized human finger, (4) has an outer surface spanning from the proximal end to the distal end, (5) has a substantially resilient, polymer-based, first layer that includes the outer surface, and (6) has a second layer beneath, and coupled, to the first layer and including a plurality of cleaning members, the plurality of cleaning members projecting outwardly from the outer surface of the first layer and substantially spanning the body length.

Although the invention is illustrated and described herein as embodied in a finger-mounted toothbrush, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the body of the finger-mounted toothbrush.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
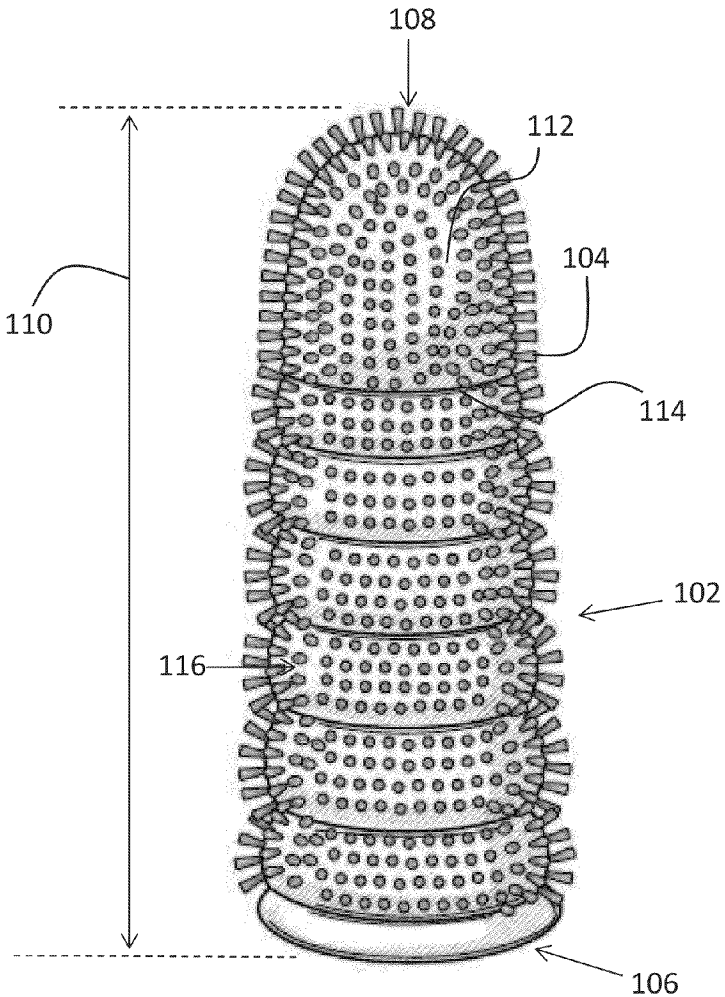
FIG. 1 is a side elevational view of a finger-mounted toothbrush in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient finger-mounted toothbrush (also referred to herein as a "FMT(s)") primarily for use with children. Embodiments of the invention provide a teeth cleaning device that can effectively and efficiently clean multiple areas of a child's teeth simultaneously. In addition, embodiments of the invention also provide a teeth cleaning device that promotes and facilitates parents in cleaning their child's teeth, while simultaneously maintaining the child's safety and measuring any potential pain or discomfort the child may be experiencing. While the present invention may be utilized in connection with children, its applications or use shall not be so limited. The present invention may also be taken advantage of by elderly or disabled persons, in addition to being used by, and on, adults themselves.

FIG. 1 shows several advantageous features of the present invention, but, as will be described below, the invention can be provided in various shapes, sizes, combinations of features and components, and varying numbers and functions of the components. The first example of a FMT 100, as shown in the side elevational view of FIG. 1, includes a body 102 having a plurality of cleaning members 104. Although it will be discussed in more detail below, the body 102 is substantially resilient to allow elastic deformation in order to protect a person's finger and provide comfort to the user. The plurality of cleaning members 104 are advantageously placed along a length 110 of the body 102 to effectively and efficiently clean multiple surfaces of a user's teeth with very little effort.

Figure 2:
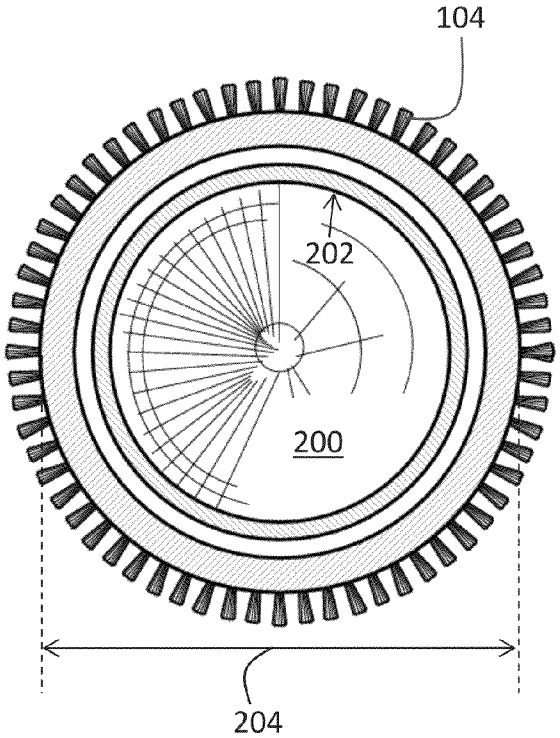
FIG. 2 is a bottom plan view of the finger-mounted toothbrush of FIG. 1 showing a proximal opening and cavity in accordance with the present invention.

The body 102 has a proximal end 106 and a distal end 108 opposite to the proximal end 106. Separating the proximal and distal ends is a body length 110. In one embodiment, the length 110 of the body 102 is about 2 inches, or sized to at least partially encapsulate a user's finger. In other embodiments, the length 110 may be less or greater than 2 inches, but should generally be less than approximately 5 inches and greater than approximately 1 inch. Referring now to FIG. 2, the body 102 defines a proximal opening 200 located at the proximal end 106 to allow ingress and egress of a person's finger. In some embodiments, the proximal opening 200 may have portions of which that extend along the length 110 of the body 102. Furthermore, the body 102 also includes an inner surface 202 that defines a cavity 300 (better shown in FIG. 3), or the section where a person's finger is placed, that spans or extends from the proximal opening 200 to a terminal location 302 (better shown in FIG. 3) along the body length 110. The body 102 also includes an outer surface 112 that is present between the proximal end 106 to the distal end 108.

In one embodiment, the outer surface 112 of the body 102 can be seen having a circular-like circumference along with width 204 of the body 102, and spans at least partially between the proximal end 106 and the distal end 108. The distal end 108, along with the rest of the body 102, may also be substantially convex, or an outer surface 112 that is primarily curved or rounded outwardly. This allows a comfortable contact surface between the FMT 100 and the inside of a user's mouth. The outer surface 112 may include ridges, divots, protrusions, and the like without deviating from the term substantially convex. In other embodiments, the outer surface 112 may be oblong, triangular, linear, curvilinear, or any other shape or combination of shapes or designs. Moreover, the inner surface 202 may be substantially concave or rounded inwardly toward the cavity 300. The inner surface 202 may have small ridges, protrusions, and the like without deviating from the term substantially concave.

Still referring to FIG. 1, the plurality of cleaning members 104 can be seen projecting outwardly from the outer surface 112. The term "plurality" is defined herein as many, typically 10 or more. In one embodiment, the FMT 100 may have approximately 50 cleaning members 104 surrounding the outer surface 112 of the body. In other embodiments, the FMT 100 may have more or less than 50 cleaning members 104, but generally there should be enough cleaning members 104 to substantially cover the body length 110. Cleaning members 104 may include bristles made of natural or synthetic fibers, ridges, or other protuberances and/or bristle-like members. As such, the bristle-like members 104 may consist of any projecting member that is substantially slender, or having the width less than the overall length, and terminally ending shortly after the outer surface 112 of the body 102. The cleaning members 104 may be made of nylon, rubber, acrylic, polyester, or other substantially resilient material.

The present invention advantageously provides a plurality of cleaning members 104 that substantially span the body length 110. This may or may not include cleaning members 104 located at the distal end 108 of the body 102. Therefore, regardless of the orientation, a user's teeth are in contact with multiple cleaning members 104. Furthermore, as the cleaning members span the length 110 of the body 102, more teeth of a user come into contact with the cleaning members 104 thereby providing a more efficient and effective cleaning device for children and adults alike. "Substantially spanning" or "span" is defined as covering most, if not all of the body length 110. For example, there may be sections along the length 110 of the body 102, i.e. around the proximal or distal ends 106, 108 and within certain ridges 114, which do not have cleaning members 104 projecting outwardly from, or covering, the body 102 without deviating in scope from the term "substantially spanning."

The plurality of cleaning members 104 define a plurality of cleaning member voids 116. The cleaning member voids 116 permit the cleaning members 104 to effectively reach all or most surfaces of a user's teeth. This is accomplished by giving space for the cleaning members 104 to bend and deflect around a user's tooth. As such, the cleaning members 104 are operable to reach the gum and gum linings to remove any plaque and tartar in addition to maintaining health gums. In addition, the cleaning member voids 116 also facilitate the runoff of debris and fluid generated from the cleaning process.

The cleaning members 104 can also be seen substantially surrounding the outer surface 112 of the body 102. This advantageously allows the FMT 100 to reach both the top and bottom teeth of a user when the FMT 100 is in use. "Substantially surrounding" is defined as circling the body 102 of the FMT 100 as shown in FIG. 2. There may be instances where the FMT 100 does not have cleaning members 104 projecting outwardly from, or circumferentially covering, certain sections of the body 102 without deviating in scope from the term "substantially surrounding." For example, the FMT 100 may have one or more images displaying from a portion of the body 102 without cleaning members 104, but yet would still be considered "substantially surrounding." Generally, however, the cleaning members 104 will cover approximately fifty percent of the circumferential area (i.e., outer surface 112) along the width 204 of the body 102. In other embodiments, the cleaning members 104 may cover more or less than fifty percent of the circumferential area along the width 204 of the body 102.

Figure 3:
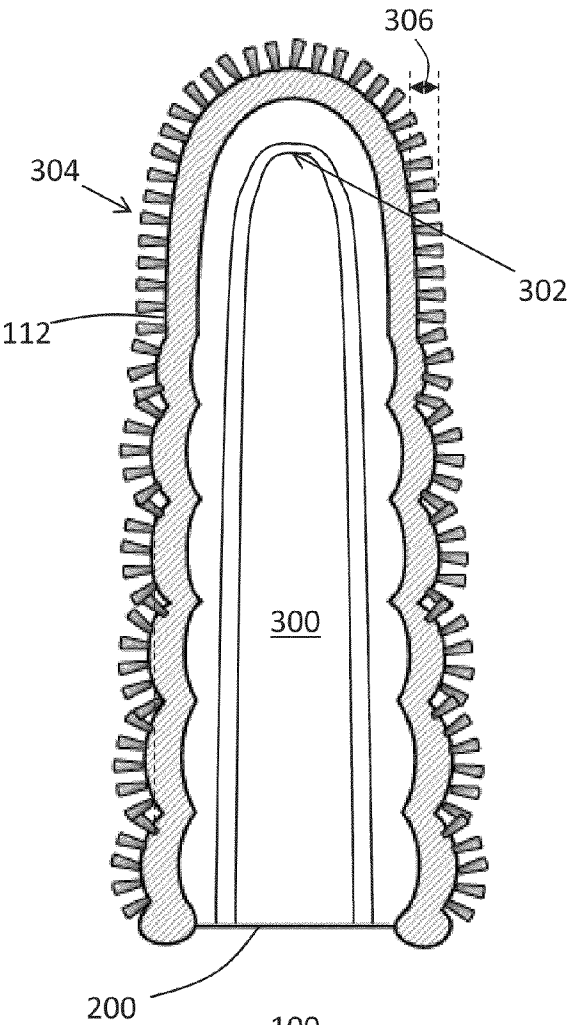
FIG. 3 is a cross-sectional view along the longitudinal length of the finger-mounted toothbrush of FIG. 1, illustrating the cavity extending from the proximal opening to a terminal location in accordance with the present invention.
Figure 4:
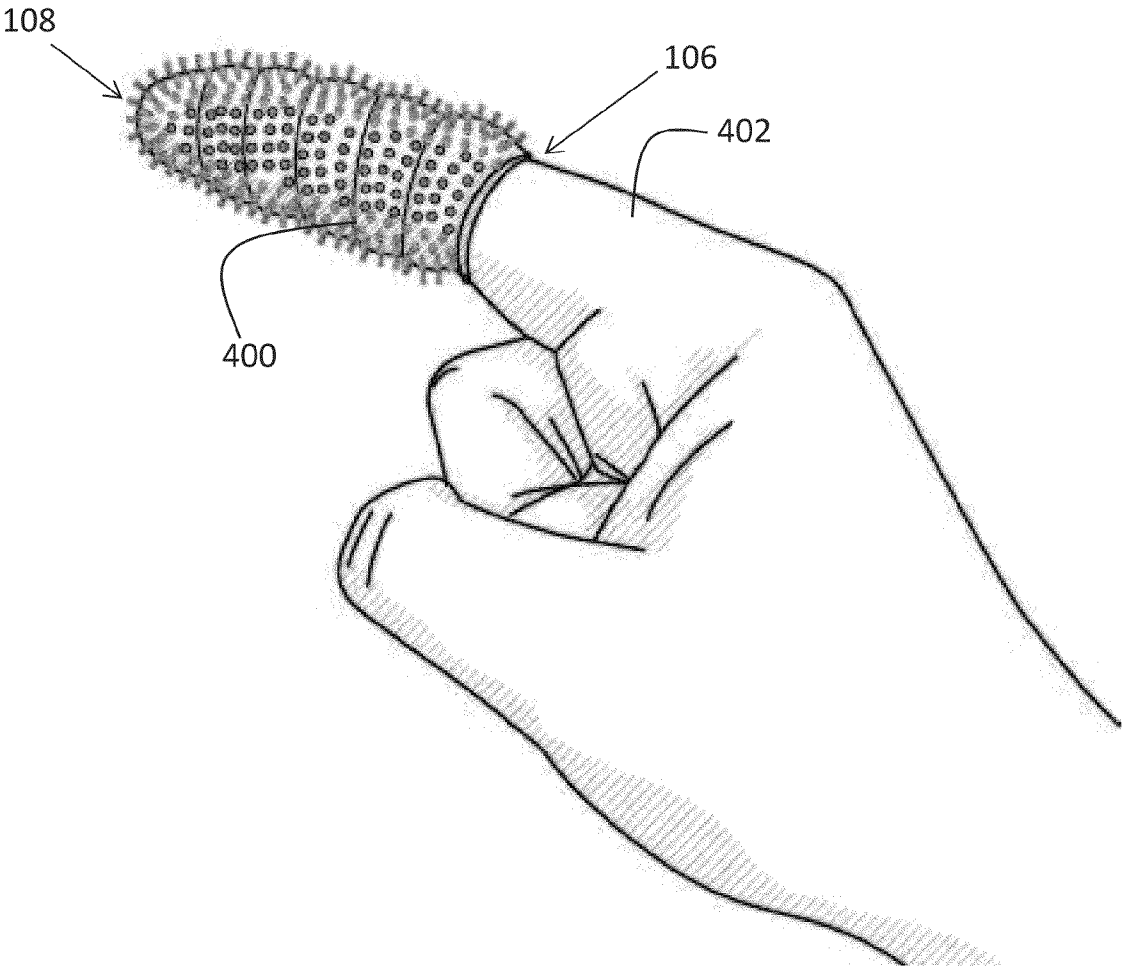
FIG. 4 is a perspective view of the finger-mounted toothbrush of FIG. 1 coupled to the finger of a user in accordance with the present invention.

With reference now to FIG. 3, the FMT 100 is illustrated in a cross-sectional view along the body length 110. In one embodiment, the cavity 300 of the FMT 100 can be seen extending to the terminal location 302, substantially at the distal end 108 of the body 102. This beneficially permits a user, whether it be a parent or child, to place most of the person's finger inside the body 102. FIG. 4 illustrates a person coupling the FMT 100 to his or her finger. As shown, the proximal end 106 of the body 102 extends to about the point of a person's hand separating the middle and proximal phalanx 400, 402 of the finger. Not only does this give a user full control of the FMT 100, it allows a person using the FMT 100 to sense any pressure placed on the body 102 by the user's teeth. As pressure is generally associated with discomfort experienced by the user, a person operating the FMT 100 will be able to stop brushing the user's teeth or change the orientation/pressure exerted on the user to minimize the discomfort.

The body 102 may be made of a substantially resilient, yet flexible, material to allow the multiple degrees of freedom in the person's finger to provide even greater versatility to the FMT 100. Advantageously, the user may then shape or contort the body 102 in various orientations to effectuate a more efficient and effective cleaning. Furthermore, as more surface area of the inner surface 202 is in contact with the finger, there is a smaller probability that the body 102 will become dislodged during use. In other embodiments, the terminal location 302 of the cavity 300 may be placed before the distal end 108, e.g., such that proximal end 106 of the body 102 extends until a point along the middle phalanx 400. In some embodiments, the body 102 may have a width 204 that varies along the length 110 to accentuate certain shapes or designs desirable to the viewing public and conducive to producing an effective cleaning of the user's teeth.

In one embodiment, as shown in FIG. 3, the plurality of cleaning members 104 that span longitudinally along the body length 110 can be seen having the distal ends 304 of said cleaning members 104 substantially aligned with one another. Said another way, the distal ends 304 of each cleaning member 104 longitudinally adjacent to one another have the same height 306 separating the distal ends 304 from the outer surface 112. Generally, the height 306 of the cleaning member 104 is dependent on the type of cleaning member 104 utilized. For bristle-like cleaning members 104, the height 306 is approximately 0.25 inches. In other embodiments, the height 306 is less or greater than 0.25 inches, but a sufficient height 306 to access those areas surrounding the user's teeth without discomfort to the user. In other embodiments, the heights 306 are not uniform and can vary from cleaning member to cleaning member.

Figure 5:
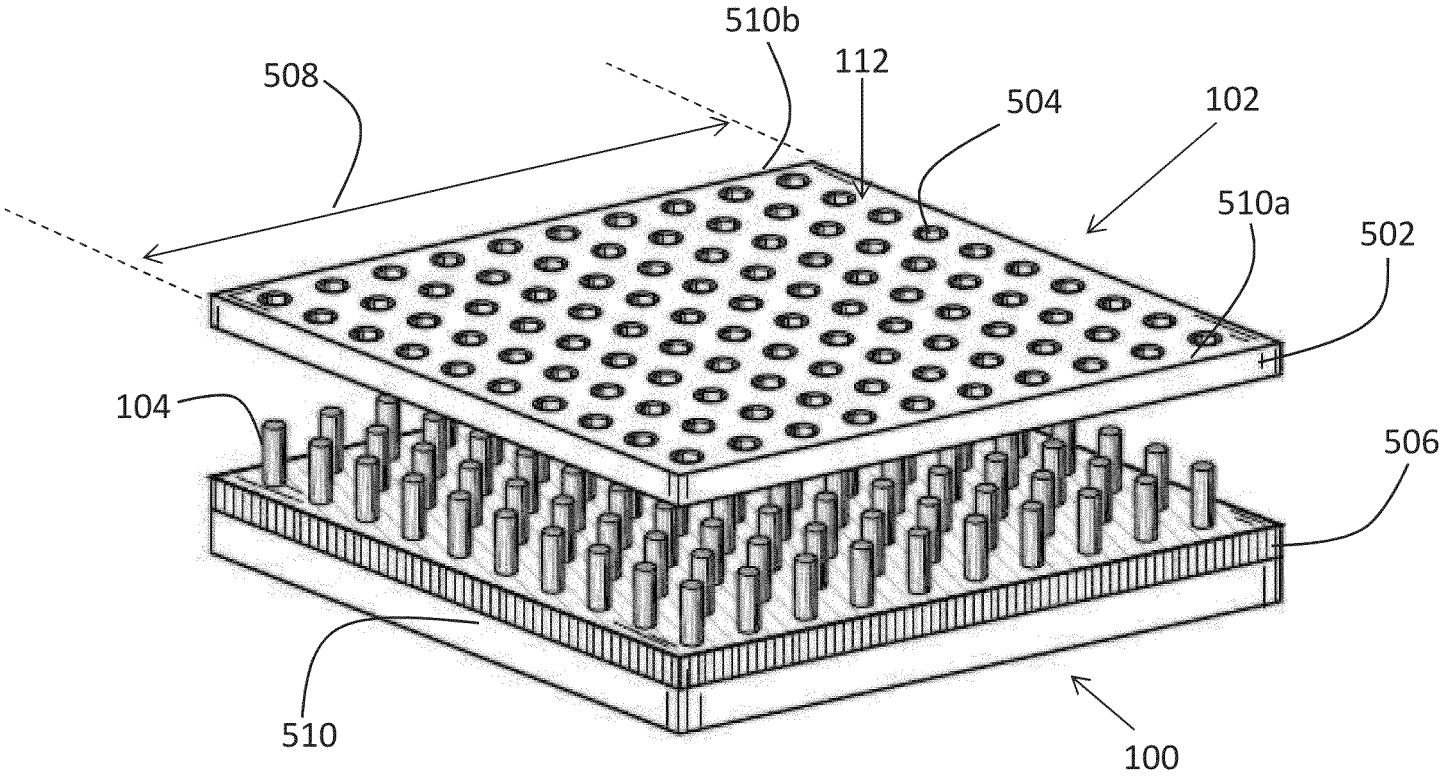
FIG. 5 is perspective view of a construction layup of the body of the finger-mounted toothbrush of FIG. 1 in accordance with an embodiment of the present invention.

FIG. 5 illustrates an exemplary layup 500 that produces the FMT 100 shown in FIGS. 1-4. In one embodiment, the layup 500 has a foraminous first layer 502 that includes the outer surface 112 of the body 102. The term "foraminious" is generally characterized as a material defining a plurality of apertures 504. Below the first layer 502 is a second layer 506 having the plurality of cleaning members 104 extending outwardly therefrom. When the first layer 502 is superposed over the second layer 506, the cleaning members 104 project through the apertures 504 to generate the outer surface 112 shown in FIGS. 1-4. In the formation process, the number of apertures 504 should, but is not necessarily required to, correspond to the number of cleaning members 104 desired to be used. Furthermore, as the cleaning members 104 are substantially resilient and substantially span the length 508 of the body 102, a rather uniform dispersion of pressure is applied on the second layer 506 during the forming process. This reduces any torsion that may affect the layup's 500 structural integrity.

An additional third layer 510 may also be utilized to encapsulate the second layer 506. Said another way, the third layer 510 also places the second layer 506 in an interposing relationship with respect to the first and third layers 502, 510. The third layer 510 includes the inner surface 202 of the body 102 and is used to provide support to the FMT 100. The third layer 510 also provides a contact surface with a person's finger to ensure a sufficient coefficient of friction necessary to prevent slippage of the FMT 100. In other embodiments, should the third layer 510 not be utilized, the bottom of the second layer 506 will include the inner surface 202. As such, the inner surface 202 will be determined based on the forming process utilized. The inner surface 202 may also have ridges or other features designed to restrict lateral movement of a person's finger. To facilitate forming the FMT 100, a pressing means may be utilized in connection with forming the body 102. In addition, heat may also be used to increase the malleability of the layers 502, 506, 510 to generate the shape shown in FIGS. 1-4.

In one embodiment, the first, second, and third layers 502, 506, 510 are made from a substantially resilient, polymer-based material, such as silicone rubber. In other embodiments, the material may be made from other materials such as isoprene rubber, butadiene rubber, or other elastomers, thermoplastics, thermosets, thermoplastic elastomers, and the like. In further embodiments, only the first and third layers 502, 510 are made from a polymer-based material and the second layer 506 is made from a mesh of composite or metallic fibers from which the cleaning members 104 extend outwardly therefrom. As such, the FMT 100 may be formed from the layup 500 as shown in FIG. 5 by folding the body 102 about an axis substantially perpendicular to the body length 508. To generate the length 110 of the FMT 100 shown in FIG. 1, the body length 508 should be approximately twice the body length 110. A die or other shaped object may be utilized to form the shape shown in FIG. 1. Again, heat may be applied to the body 102, to a point before a melting temperature of the material, to plastically deform the body 102 around the die. The edges 510*a*, 510*b* of the body 102 may then be welded or fused together to create the uniform-shaped object of FIG. 1.

In other embodiments, the body 102 may be formed into the shape of FIG. 1 before the curing process of the polymer-based material, as the material is still in a substantially deformable condition. The edges 510*a*, 510*b* may then be abutted with one another and sealed using adhesives, heat, or other means known in the art. In further embodiments, the body 102 of FIG. 1 may be formed by creating two separate sections (one being similar to the section shown in FIG. 3) that are combined and having any of the abutting edges sealed using any of the above-described methods or those manufacturing methods known in the art. Some exemplary forming methods employed to create some of the above features may include casting, compression molding, transfer molding, and reaction injection molding (RIM). In further embodiments, the body 102 may be formed into a unibody structure through one or more of the above-mentioned molding techniques. Following the formation of the unibody structure, the plurality of cleaning members 104 are then coupled thereto using adhesives or other coupling mechanisms. Moreover, the cleaning members 104 may also be formed out of the same material used to generate the unibody structure such that the members 104 would also be formed in the molding process.

Figure 6:
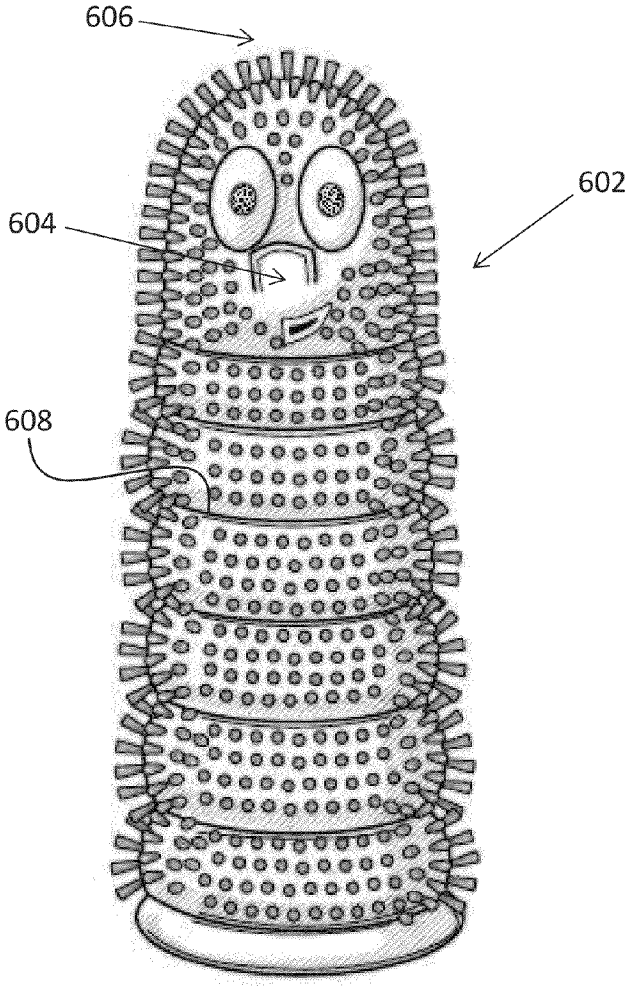
FIG. 6 is a side elevational view of a finger-mounted toothbrush having an image located at a distal end of the toothbrush in accordance an exemplary embodiment of the present invention.

With reference now to FIG. 6, another exemplary embodiment of a FMT 600 is shown from a side elevational view. FIG. 6 illustrates the body 602 including an image 604 located substantially at the distal end 606 of the body 602. In other embodiments, the image 604 may be located at other sections or areas of the body 602. The image advantageously stimulates a child's curiosity and generally creates a FMT 100 that is non-threatening and comforting to a child's sensibilities. In one embodiment the cleaning members 104 may completely cover the image 604. In other embodiments, the cleaning members 104 at least partially cover the image 604. In addition to the image 604, the entire body 602 may be shaped in the form of an animal, such as a caterpillar (as shown in FIG. 6). This may be accomplished by utilizing one or more ridges 608 that may be formed in the above-described manufacturing processes. Again, this makes an aesthetically pleasing appearance to a FMT 100 that was not achieved with the prior-art cleaning apparatus. The image 604 may consist of a face or any reproduction or imitation of the form of a person or thing. Said another way, the image 604 and shape of the body 602 may be a visual representation or likeness of an object, person, or thing. In addition, the ridges 608 create textile differences and, in some embodiments, cause the bristles to point in different directions. In these embodiments, improved brushing is accomplished due to the multi-angled bristles hitting the tooth at a plurality of angles.

A finger-mounted toothbrush has been disclosed that provides an apparatus to effectively and efficiently clean multiple areas of a child's teeth with minimal effort and time expended by the user, whether that it be parents or children. In addition, the finger-mounted toothbrush advantageously provides a person the ability to sense, or feel, any potential discomfort experienced by the user which increases the user's safety and decreases any potential pain or discomfort the child may be experiencing. Again, while the finger-mounted toothbrush may be utilized in connection with children, it may be used by elderly or disabled persons, in addition to being used by, and on, adults themselves.

The invention claimed is:

1. A finger-mounted toothbrush comprising:
- a body:
  - having a proximal end, a distal end opposite to the proximal end, and a length separating the proximal and distal ends;
  - defining a proximal opening at the proximal end;
  - having an inner surface defining a cavity extending from the proximal opening to a terminal location along the body length, the cavity sized for an average-sized human finger; and
  - having an outer surface spanning from the proximal end to the distal end;
- a plurality of cleaning members:
  - projecting outwardly from the outer surface of the body;
  - substantially spanning the entire body length; and
  - defining a plurality of cleaning member voids;
- a first layer including the outer surface of the body; and
- a second layer substantially spanning the entire first layer and creating a continuous uniform inside surface, the second layer including the plurality of cleaning members directly coupled thereto and extending therefrom.

2. The finger-mounted toothbrush according to claim 1, wherein:
- the plurality of cleaning members substantially surround the outer surface of the body.

3. The finger-mounted toothbrush according to claim 2, wherein:
- the terminal location is located substantially at the distal end of the body.

4. The finger-mounted toothbrush according to claim 1, wherein the plurality of cleaning members further comprise:
- a distal end, wherein the distal ends of the cleaning members spanning longitudinally along the body length are substantially aligned with one another.

5. The finger-mounted toothbrush according to claim 1 wherein:
- the first layer is foraminous; and
- a superposition of the first layer over the second layer places the cleaning members in a position that projects outwardly from the outer surface of the body.

6. The finger-mounted toothbrush according to claim 5, further comprising:
- a third layer that includes the inner surface of the body, the third layer placing the
- second layer in an interposing relationship with the first and third layers.

7. The finger-mounted toothbrush according to claim 6, wherein:
- the first and third layers are of a substantially resilient, polymer-based, material.

8. The finger-mounted toothbrush according to claim 1, wherein the body comprises:
- an at least three-layer layup including the first layer and the second layer, wherein two layers of the at least three-layer layup are a substantially resilient, polymer-based, material.

9. The finger-mounted toothbrush according to claim 1, further comprising:
- an image located substantially at the distal end of the body.

10. The finger-mounted toothbrush according to claim 9, wherein:
- the body is at least partially formed in a shape of at least one of an animal and a character.

11. A finger-mounted toothbrush comprising:
- a body:
  - having a proximal end, a distal end opposite to the proximal end, and a length separating the proximal and distal ends;
  - defining a proximal opening at the proximal end; and
  - having an outer surface and an inner surface, the inner surface defining a cavity extending from the proximal opening to a terminal location along the body length and sized for an average-sized human finger;
- a plurality of bristle-like cleaning members:
  - extending outwardly from the outer surface of the body;
  - substantially surrounding a circumferential outer surface of the body; and spanning discontinuously along the body length;

a first layer including the outer surface of the body; and a second layer substantially spanning the entire first layer and creating a continuous uniform inside surface, the second layer including the plurality of cleaning members directly coupled thereto and extending therefrom.

12. The finger-mounted toothbrush according to claim 11, wherein:

the outer surface of the body is substantially convex and the inner surface of the body is substantially concave.

13. The finger-mounted toothbrush according to claim 11, wherein:

the terminal location is located substantially at the distal end of the body.

14. The finger-mounted toothbrush according to claim 11, wherein the plurality of bristle-like cleaning members further comprise:

a distal end, wherein the distal ends of the cleaning members spanning longitudinally along the body length are substantially aligned with one another.

15. The finger-mounted toothbrush according to claim 11, wherein:

the first layer is foraminous; and a superposition of the first layer over the second layer places the cleaning members in a position that projects outwardly from the outer surface of the body.

16. The finger-mounted toothbrush according to claim 15, further comprising:

a third layer that includes the inner surface of the body, the third layer placing the second layer in an interposing relationship with the first and third layers.

17. The finger-mounted toothbrush according to claim 11, wherein the body comprises:

an at least three-layer layup including the first layer and the second layer, wherein two layers of the at least three-layer layup are a substantially resilient, polymer-based, material.

18. A finger-mounted toothbrush comprising:

a body:

having a proximal end, a distal end opposite to the proximal end, and a length separating the proximal and distal ends;

defining a proximal opening at the proximal end;

having an inner surface defining a cavity extending from the proximal opening to a terminal location along the body length, the cavity sized for an average-sized human finger;

having an outer surface spanning from the proximal end to the distal end;

having a substantially resilient, polymer-based, first layer that includes the outer surface; and having a second layer beneath, and coupled, to the first layer, the second layer creating a continuous uniform inner surface and including a plurality of cleaning members directly coupled to the second layer, the plurality of cleaning members projecting outwardly from the outer surface of the first layer and substantially-surrounding the entire outer surface.

19. The finger-mounted toothbrush according to claim 18, further comprising:

a foraminous first layer, wherein a superposition of the first layer over the second layer places the cleaning members in a position that projects outwardly from the outer surface of the body.

20. The finger-mounted toothbrush according to claim 19, further comprising:

a third layer that includes the inner surface of the body, the third layer placing the second layer in an interposing relationship with the first and third layers.

* * * * *